US007743522B2

(12) United States Patent
Ruzio

(10) Patent No.: US 7,743,522 B2
(45) Date of Patent: Jun. 29, 2010

(54) COMPOSITE TOOL FOR LAYOUT AND INSTALLATION OF BACK SPLASHES

(76) Inventor: Gjoko V. Ruzio, 5815 Carversville Rd., Doylestown, PA (US) 18901-1320

( * ) Notice: Subject to any disclaimer, the term of this patent is extended or adjusted under 35 U.S.C. 154(b) by 125 days.

(21) Appl. No.: 12/191,570

(22) Filed: Aug. 14, 2008

(65) Prior Publication Data

US 2010/0037398 A1 Feb. 18, 2010

(51) Int. Cl.
*B43L 7/00* (2006.01)

(52) U.S. Cl. ..... 33/492; 33/DIG. 20

(58) Field of Classification Search ..... 33/492, 33/465, 19.1, 19.2, 19.3, 32.1, 32.2, 32.3, 33/27.03, 27.031, 27.032, 27.033, 425, 427, 33/419, 41.1

See application file for complete search history.

(56) References Cited

U.S. PATENT DOCUMENTS

| | | | | | |
|---|---|---|---|---|---|
| 1,840,135 | A | | 1/1932 | Schutt | |
| 1,877,341 | A | * | 9/1932 | Kurtz, Jr. | 33/492 |
| 2,579,664 | A | * | 12/1951 | Gleasman | 33/492 |
| 2,802,259 | A | | 8/1957 | Stoner | |
| 2,823,461 | A | * | 2/1958 | Schneider | 33/492 |
| 3,119,424 | A | | 1/1964 | Henry | |
| 3,416,485 | A | * | 12/1968 | Phillips | 33/492 |
| 3,805,390 | A | * | 4/1974 | Craig | 33/27.03 |
| 4,438,538 | A | | 3/1984 | Larsen | |
| 4,958,399 | A | | 9/1990 | Toal et al. | |
| 5,033,200 | A | * | 7/1991 | Leung | 33/485 |
| 5,125,459 | A | * | 6/1992 | Richards | 15/235.4 |
| 5,231,729 | A | | 8/1993 | Rose | |
| 5,426,859 | A | * | 6/1995 | Concari et al. | 33/27.02 |
| 6,178,586 | B1 | | 1/2001 | Jafarmadar | |
| 6,205,610 | B1 | | 3/2001 | Westthorp | |
| 6,240,650 | B1 | | 6/2001 | Olson | |
| 6,305,093 | B1 | * | 10/2001 | Venola | 33/451 |
| 6,505,408 | B1 | | 1/2003 | Talamantez et al. | |
| 6,568,021 | B1 | | 5/2003 | Wood | |
| 6,732,441 | B2 | | 5/2004 | Charay et al. | |
| 6,941,605 | B2 | | 9/2005 | McCreesh | |
| 2005/0081395 | A1 | * | 4/2005 | Miller | 33/492 |

* cited by examiner

*Primary Examiner*—Yaritza Guadalupe-McCall
(74) *Attorney, Agent, or Firm*—Volpe and Koenig, P.C.

(57) ABSTRACT

A multi-purpose hand tool having opposing planar surfaces. A first long side has a linear edge for drawing straight lines. Graduations are provided along a beveled surface for use in measurement. Short sides perpendicular to the straight edge facilitate placement in an inside corner. A remaining side has serrations for spreading an adhesive. A cover is secured to the main body by pins in the cover and openings in the main body. The main body and cover house a level. A viewing window incorporates a lens for magnification. Guideways are configured to receive a straightedge, the guideways being aligned at precise, given angles. Projections in each guideway cooperate with a groove provided along only one given surface of the straightedge to assure proper orientation of the straightedge in the guideways. The main body and cover have smooth undulations for receiving and seating the fingers. A recess in the cover seats the tips of the fingers. A convex surface surrounding the viewing window protects the level. Spaced openings along the tool facilitate measurement and marking.

25 Claims, 7 Drawing Sheets

COMPOSITE TOOL FOR LAYOUT AND INSTALLATION OF BACK SPLASHES

FIELD OF INVENTION

The present invention relates to method and apparatus providing a layout for and installing tile and more particularly to method and apparatus employing a composite tool for measuring and installing tile and especially tile back splashes.

BACKGROUND

The installation of tile and especially back splashes employed in bathrooms, and kitchens and other like applications requires a number of measurements for positioning, aligning and setting tile, including providing markings for cutting of the tile, the application of an appropriate adhesive or mastic and proper placement of the tile including assuring that the back splash is level. These activities necessitate the use of a number of different tools to perform these functions properly and efficiently. Nevertheless, it is highly desirable to provide a tool or tools which, while performing all of the necessary functions, nevertheless reduce the number of tools required to perform such functions.

SUMMARY

The present invention is characterized by comprising a unitary, one-piece tool for accurately measuring and setting up a surface for placement of tiles, such as ceramic tiles, to provide a back splash, for example, the tool having a convenient handle, an accurate ruler along a measurement edge thereof; a spreader edge for spreading mastic; an integral level for assuring proper alignment of the tiles and the like; guide ways extending through the tool for accurate alignment of guides for marking a layout and having a holder for a pencil which insertable and retainable within a storage opening to retain a pencil in readiness for use; a layout straight edge may be selectively inserted into one of a plurality of guideways at precision angles of 45°, 90° degrees and 135° degrees; and openings at accurately spaced intervals along the main measurement straightedge serve as center points for drawing an arc. The short sides of the composite tool are arranged at precise right angles to the long sides, enabling the tool to be placed along adjacent horizontal and vertical surfaces which are substantially flat and planar and to conform to an inside corner of a surface upon which tile is to be placed. All of the components that make up the tool are handy and convenient for use.

BRIEF DESCRIPTION OF THE DRAWING(S)

The present invention will be understood from a consideration of the detailed description and drawings, wherein like elements are designated by like numerals and, wherein.

DETAILED DESCRIPTION OF THE PREFERRED EMBODIMENT(S)

Figure 1A:
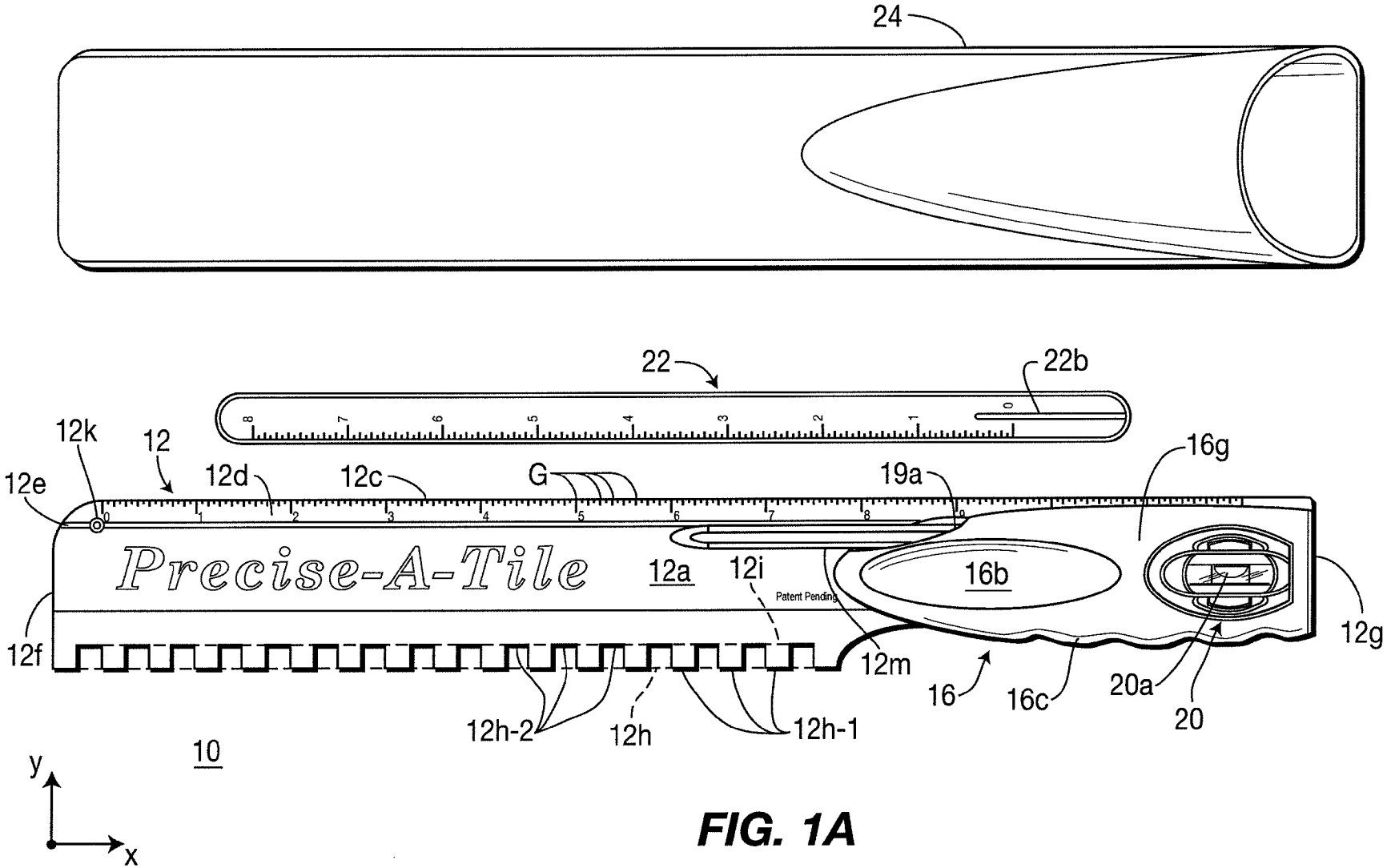
FIGS. 1A and 1B are front and rear views of a tool embodying the principles of the present invention.
Figure 1B:
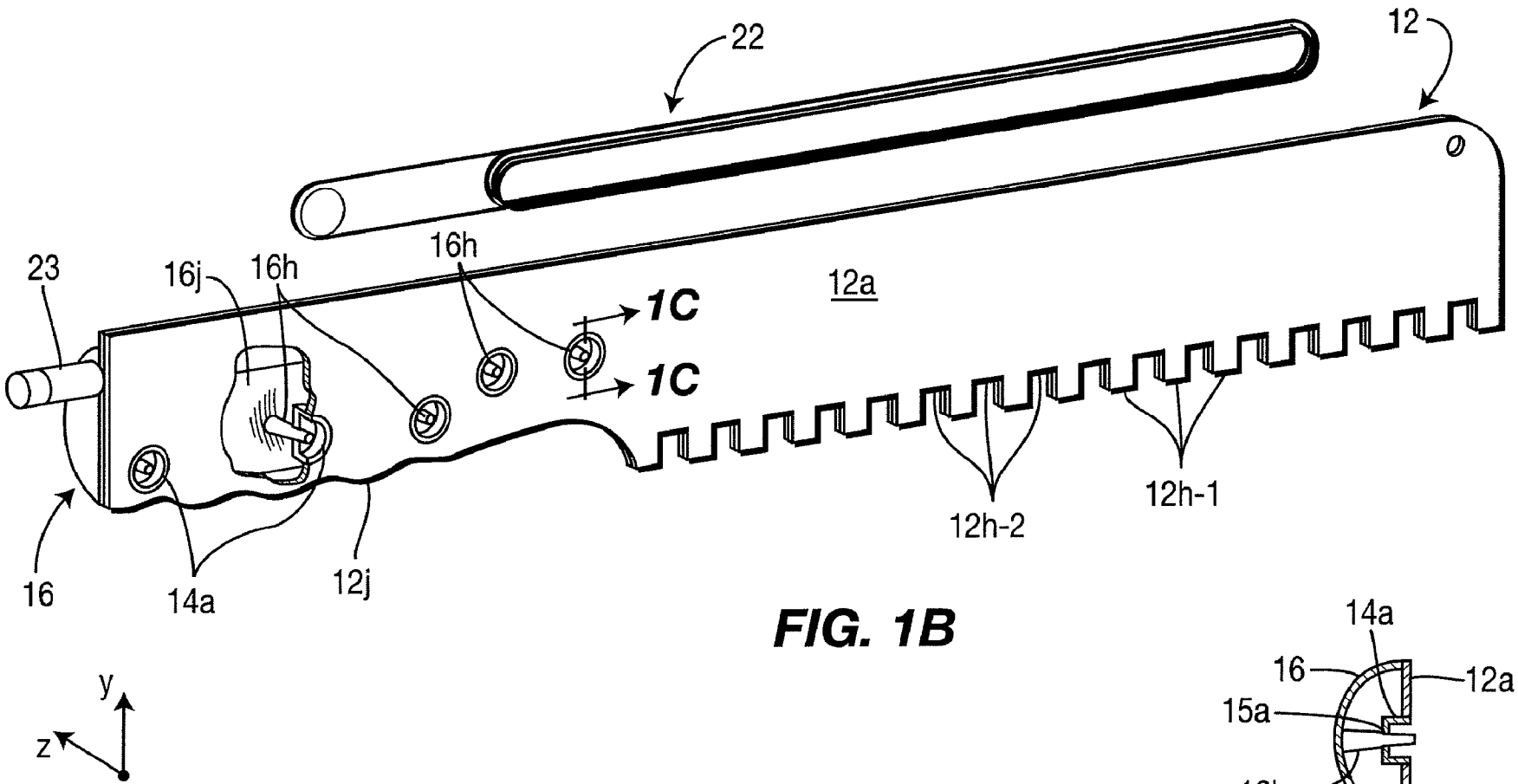
Figure 1C:
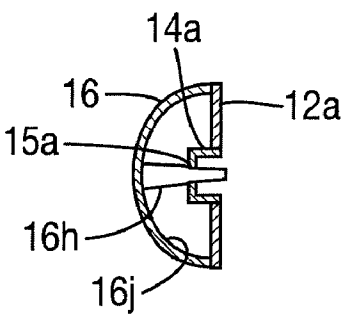
FIG. 1C is a sectional view looking in the direction of arrows 1C-1C in FIG. 1B and showing the manner in which the main body and cover are joined together.

Making reference to FIGS. 1A through 3B, there shown therein a tool 10 comprised of the main body 12 having front and rear faces 12*a*, 12*b* which are planar and preferably parallel to one another. The top edge 12*c* of main body 12 is straight and linear and serves as a straight edge for measurements and marking in much the same way as a conventional ruler. A beveled surface 12*d*, which tapers from a wider end 12*e* to straight edge 12*c* is provided with graduations G, which serve a measuring function. The graduations G are preferably either in a meter scale or an inch scale depending upon the particular application. The beveled surface 12*d* facilitates easy reading of the graduations G when the back surface 12*b* is placed against a vertical wall.

The short sides 12*f* and 12*g* are linear and are perpendicular to the top edge 12*c* and the bottom edge defined by dotted line 12*h*. The bottom edge is provided with a plurality or serrations defining "peaks" 12*h*-1 and "valleys" 12*h*-2 having a squared off shape to form a configuration which may be likened to a square-pulse waveform, the outer edges of the "peaks" 12*h*-1 lying along imaginary line 12*h* which defines the bottom "edge" while the "valleys" lie along a dotted line 12*i*. Serrations of this type are quite common in the tiling industry and serve to facilitate smooth spreading of a mastic (or other suitable adhesive not shown) on a surface on which tiles are placed. The ends 12*f* and 12*g* may each be placed against an inside corner, which placement is facilitated by providing the planar rear surface 12*b* and side surfaces 12*f*-1, 12*g*-1.

The cover 16 is hollow and is provided with a plurality of projections 16*h*, typically referred to as "scrunch pins" integrally joined to the concave interior surface 16*j* of cover 16. The left-hand end of body 12*a* (viewed in FIG. 1B) is provided with a plurality of bosses 14*a*, which are integrally mounted to main body 12*a* and extend outwardly from the body 12*a* and into the hollow, concave interior of cover 16. Bosses 14*a* are each provided with central openings 15*a* which are smaller in diameter than bosses 14*a*. Each opening 15*a* is aligned with one of the projections 16*h* and receives a projection provided along the interior surface 16*j* of cover 16. Each of the projections, commonly referred to as scrunch pins 16*h*, as set forth above, preferably have an outer diameter which is at least as large as the inner diameter of openings 15*a* so as to provide a "press-fit" with the bosses 14*a*. Projections 16*h* may either be cylindrical in shape or slightly tapered or non-cylindrical as long as the outer-most edges of the pins 16*h* provide a force-fit with the openings 15*a* in bosses 14*a*, which openings likewise may assume a variety of different shapes. If desired, the bosses 14*a* may be formed on the interior concave surface of cover 16 and projections 16*h* may be formed or otherwise provided on the main body 12. The projections may be scrunch pins that have annular protrusions which are wedged into the openings 15*a* to secure cover 16 to main body 12.

Figure 3A:
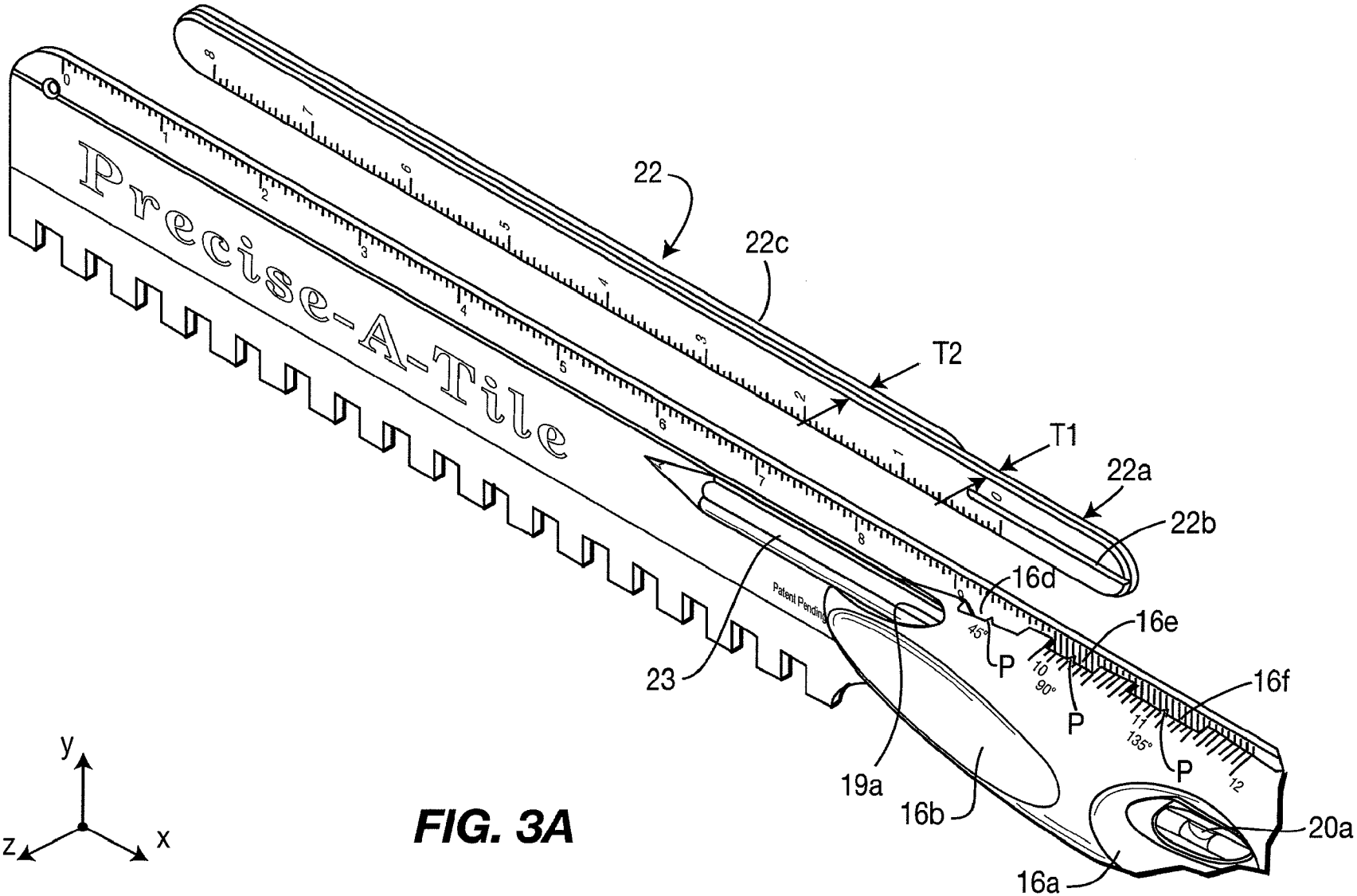
FIGS. 3A and 3B are detailed perspective views of the handle portion of the tool of FIG. 1A.
Figure 3B:
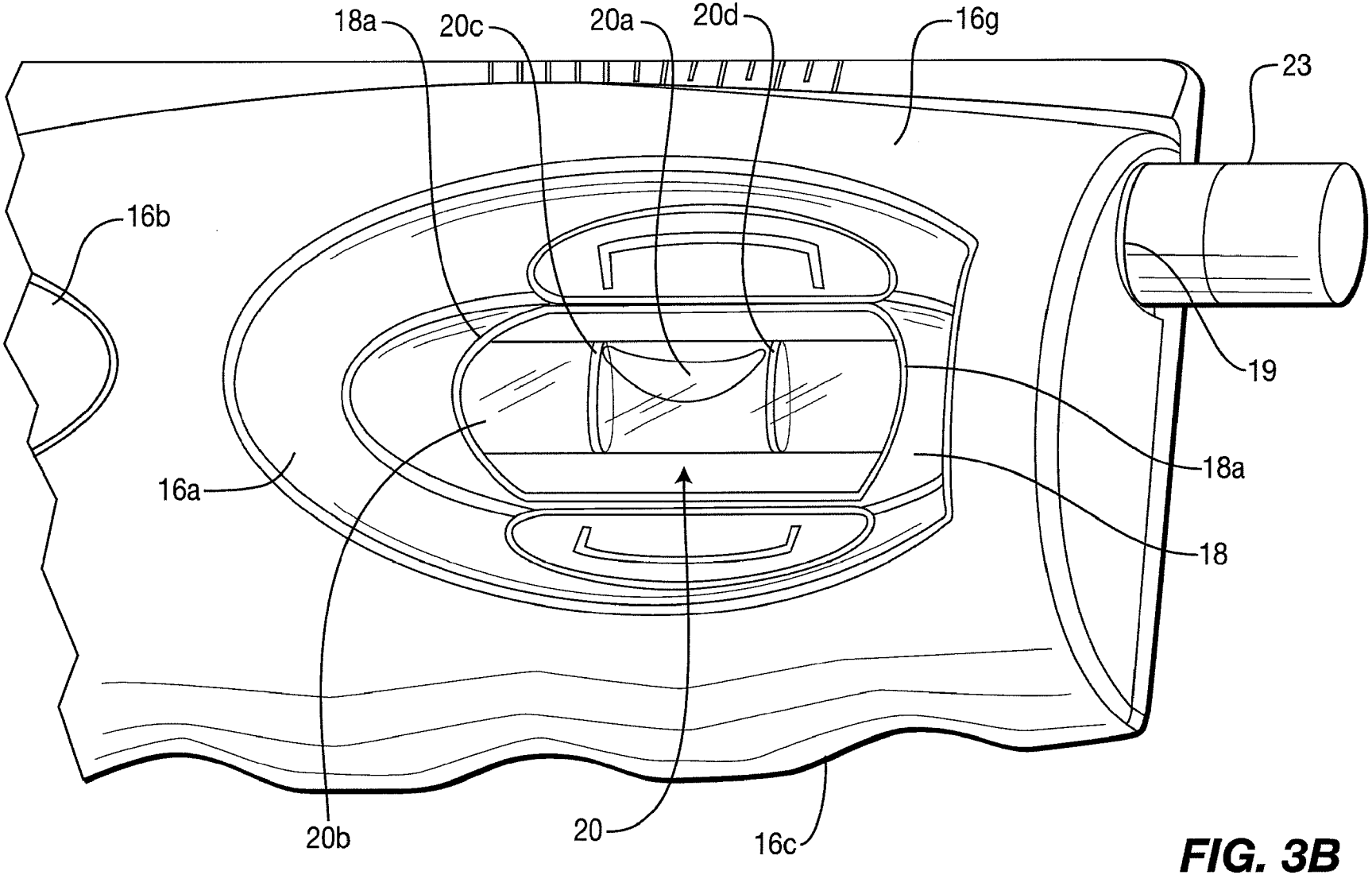

The main body 12*a* is further provided with a cradle 18 shown in greater detail in FIG. 3B and having a curved concave interior portion 18*a* which serves to encircle opposite ends of a level 20. The cover 16 is provided with an opening 16*a* for viewing the "bubble" 20*a* of level 20. A transparent window 20*b* of level 20 is secured within opening 16*a* to facilitate viewing of bubble 20*a*, the window further serving as a lens to provide magnification of the level to further facilitate viewing of the level. When the main member 12 is placed on a horizontal surface, bubble is positioned between the markings 20*c*, 20*d*, otherwise, at least the left-hand end of bubble 20*a* will move to the left of marker 20*c* or at least the right hand end of the bubble will move to the right of marking 20*d* when the main body portion is placed upon a surface that is not level.

The exterior surface 16*g* of cover 16 is further provided with an oval-shaped concave recess 16*b* which facilitates gripping of the tool as will be described below.

Figure 2A:
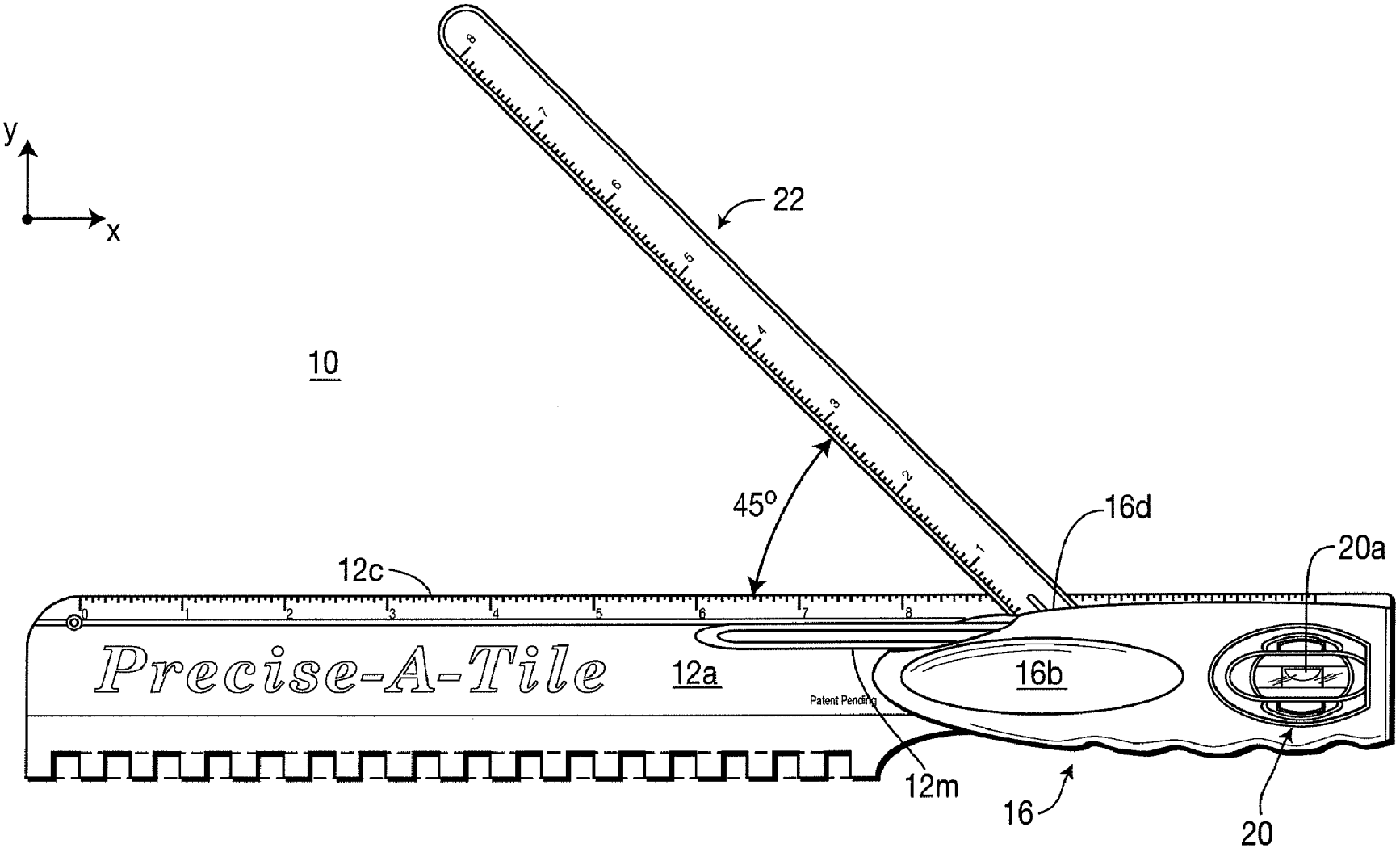
FIGS. 2A, 2B and 2C are front views of the tool of FIG. 1A with the removable straightedge respectively mounted in 45°, 90° and 135° angle guideways.
Figure 2B:
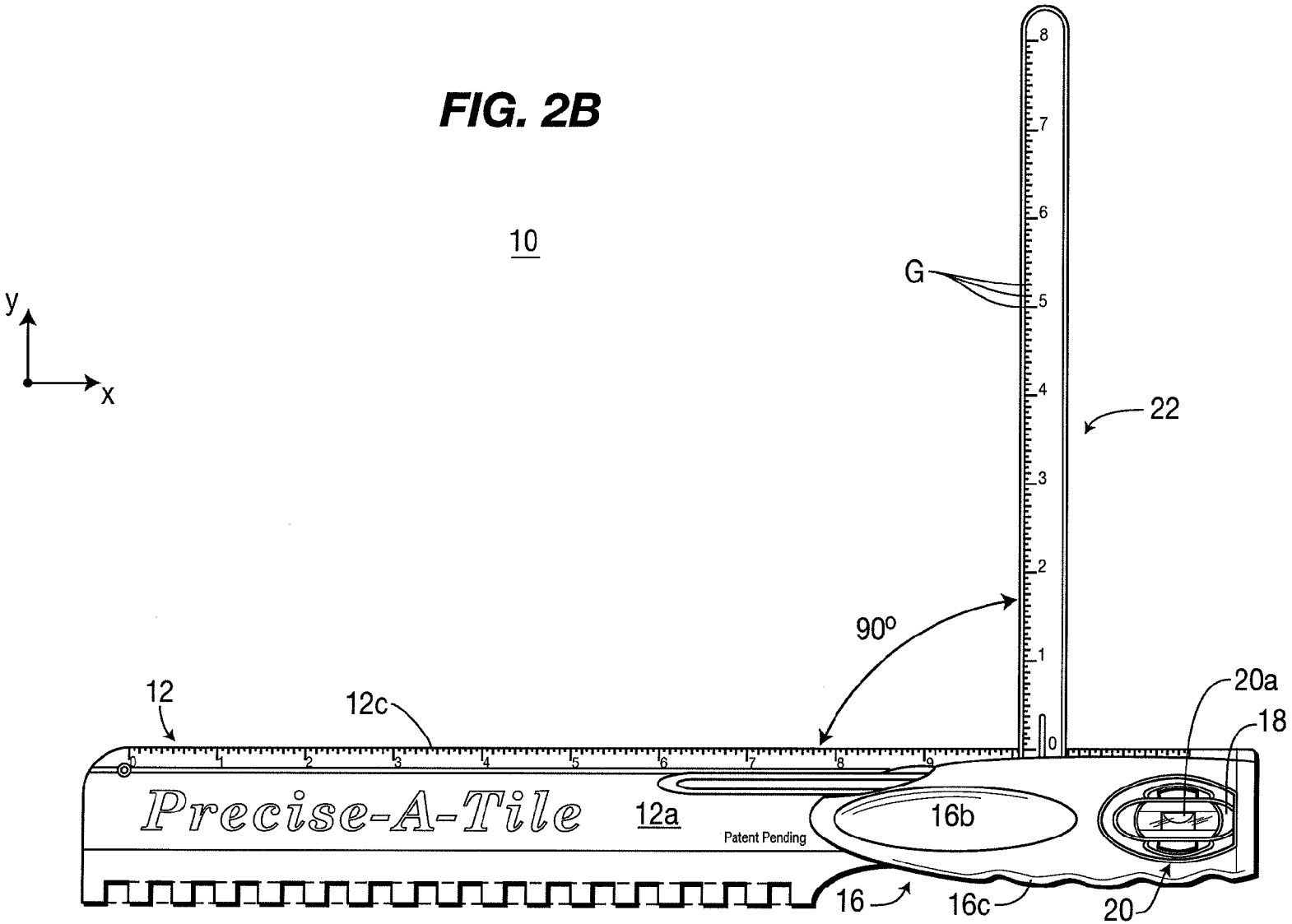
Figure 2C:
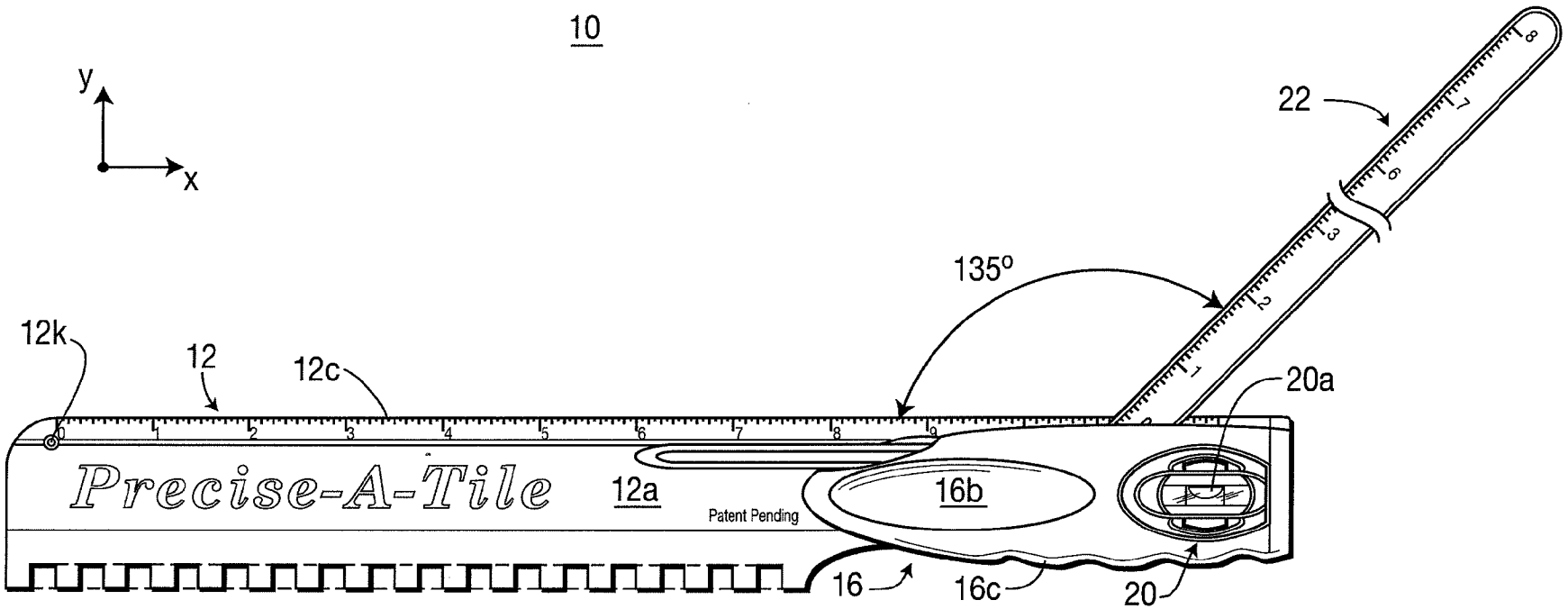

The lower edge of one end portion of main body 12*a* has a smooth undulating surface 12*j* which conforms with a similar undulating surface 16*c* which is aligned with the undulating surface 12*j* when cover 16 is joined to main body 12*a* as shown, for example, in FIGS. 1A, 2B and 3B. The undulating surfaces 16*c* and 12*j* serve as a means for comfortably seating the fingers of the person holding the tool which thereby enhances the gripping of the tool. The concave recess 16*b* serves a region for receiving and seating the fingers of the hand holding the tool.

Cover 16 is further provided with guideways 16*d*, 16*e* and 16*f* which are integrally formed along the top of cover 16, as shown in FIG. 3A. Guideways 16*d*, 16*e* and 16*f* provide receiving openings for insertion of a straightedge 22 having a substantially rectangular-shaped cross-section at end 22*a*. Guideways 16*d*, 16*e* and 16*f* conform to this cross-sectional shape to each selectively receive and retain straightedge 22, the guideways being sized to receive and retain the straightedge. Each opening 16*d*, 16*e*, 16*f* is provided with a projection P which enters a groove 22*b* in member 22 to assure that member 22 is installed into a guideway in the proper orientation. The thickness T1 of end 22*a* is chosen to fit into the guideways 16*d*-16*f* without any "play". The remaining portion of straightedge 22, which extends beyond a guideway opening has a thickness T2 which is substantially greater than T1 and is chosen so that when member 22 is inserted into one of the guideways, its rear surface 22*c* is substantially flush with the rear surface 12*b* (see FIGS. 1B and 3A), to thereby facilitate its use to perform a marking and/or measuring function. Handle 16 cooperates with body 12*a* to define an elongated, pencil retention opening 19 for receiving pencil 23. A groove 12*m* receives and seats the pencil tip end 23*a* of pencil 23, which extends beyond the left-hand end 19*a* of opening 19. Elongated opening 19 provides for handy storage of pencil 23. The opening 19 is preferably provided with an interior projection, similar to projections P to provide a force-fit between opening 19 and pencil 23.

The guideways 16*d*, 16*e* and 16*f* respectively form precise angles of 45°, 90° and 135° degrees with straightedge 12*c*, for example, to automatically align the straightedge 22 at the desired angle relative to the straightedge 12*c*. The member 22 may be removed and selectively inserted into any of the guideways 16*d*, 16*e* and 16*f* to obtain the typically desirable angular orientation for marking and/or measuring purposes.

The level 20 is recessed below the curved convex surface 16*g* of cover 16 to provide protection for the level 20 and the viewing/magnification window 20*b*. The main body 12*a* is further provided with an opening 12*k* to facilitate drawing circles typically required during the layout of a tile installation, using opening 12*k* as a center point, aligning the pencil tip 23*a* with a selected one of the graduations and pivoting member 12 about center point 12*k* to obtain an arc of a desired radius.

A carrying case 24, shown in FIG. 1A, is formed of a suitable inexpensive plastic or fabric for storing and carrying members 12 and 22.

Although the tool described herein is uniquely adapted for use in the design, layout and installation of tile, for installations such as backsplashes and the like, the tool likewise finds use in other applications and is not limited to design, layout and installation of backsplashes. It should be further noted that the tool may be manufactured as either a "left-hand" or "right-hand" tool, the handle being provided either at the right-hand end or the left-hand end.

The nature of the design of the present invention is such as to greatly facilitate its manufacture and assembly. For example, the main components 12 and 16 may be molded such as by injection molding and formed of a suitable plastic material which is rugged, lightweight and highly serviceable.

What is claimed is:

1. A multi-purpose hand tool comprising:

a main body having first and second opposing major surfaces, the first major surface being substantially planar to facilitate placement of the first main surface of a wall to be marked during a marking operation;

a surface portion of the second major surface adjacent to the straight-edge having graduations there along being positioned adjacent said straight edge to facilitate performance of measurements along said surface to be marked;

at least one short side of said main body being straight and linear and perpendicular to said straight edge to facilitate placement of the tool against surfaces having an inside corner;

a remaining long side of said tool being serrated to facilitate spreading of an adhesive preparatory to laying tile members upon the marked surface;

a cover fixed to one end of said main body, said cover and an adjacent edge of said main body having smoothly curved undulations which cooperate to provide a surface for placement and comfortable seating of fingers of a hand holding said tool; and a cradle arranged within the region of the main body enclosed by said cover for positioning and supporting a level, said cover having an opening for observing said level.

2. The tool of claim 1 wherein said cover is joined to said main body by providing integral bosses mounted on one of said main body and cover and cooperating with pins mounted on a remaining one of said cover and main body and being force-fittingly inserted into said bosses.

3. The tool of claim 1 wherein said cover is provided with at least one guide-way having a shape configured to conform to a shape of a straightedge having a rectangular-shaped cross-section, said guideway being aligned at a precise given angle relative to said straight edge.

4. The tool of claim 3 wherein said guideway is provided with a projection which slidably engages a groove provided in only one surface of said straightedge to assure proper orientation of the straightedge in the guideway.

5. The tool of claim 1 wherein said cover is provided with a opening for receiving and storing a pencil.

6. The tool of claim 5 further comprising a retention member integral with and projecting inwardly from said opening to force-fittingly receive a pencil inserted into said opening to assure retention of the pencil within the opening when not in use.

7. The tool of claim 6 wherein said opening is configured to conform to a cross-sectional shape of said pencil to prevent play between said pencil and said opening.

8. The tool of claim 3 wherein a portion of said straightedge extending beyond said guideway has a rear surface configured to be flush with a rear surface of said tool to facilitate its use.

9. The tool of claim 1 wherein said cover is provided with at least first and second guideways each having a shape configured to conform to a shape of a straightedge having a rectangular-shaped cross section, said guideways each being aligned at a precise given angle relative to said straightedge.

10. The tool of claim 9 wherein said guideways, are aligned at 45° and 90° relative to said straightedge.

11. The tool of claim 9 wherein said guideway is provided with a projection which slidably engages a groove provided in only one surface of said straightedge to assure proper orientation of the straightedge when inserted into the guideway.

12. The tool of claim 9 further comprising a projection in said guideway extending into a groove provided on only one given surface of said straightedge to assure proper orientation of the straightedge when inserted into the guideway.

13. The tool of claim 12 wherein a portion of said straight-edge extending beyond said guideway has a rear surface configured to be flush with a rear surface of said tool to facilitate its use.

14. The tool of claim 9 wherein said guideways are configured to conform to a cross-sectional shape of said straight-edge to prevent play between said straightedge and said guideways, said straightedge having a rectangular-shaped cross-section.

15. The tool of claim 1 wherein said opening is provided with a transparent window to facilitate observation of said level.

16. The tool of claim 15 wherein said window comprises a lens to magnify the image of the level.

17. The tool of claim 1 wherein said serrations are substantially square-shaped serrations.

18. The tool of claim 1 wherein said surface adjacent to the straight-edge is beveled to facilitate reading of the graduations therealong.

19. The tool of claim 1 wherein said cover is provided with a plurality of guideways each having a shape configured to conform to a shape of a straightedge have a rectangular-shaped cross-section, said guideways being aligned at a precise, given different angles relative to said straight edge.

20. The tool of claim 19 wherein said guideways are each configured to conform to a cross-sectional shape of said straightedge to prevent play between said straightedge and said guideways, said straightedge having a rectangular shaped cross-section.

21. The tool of claim 19 wherein a portion of said straight-edge extending beyond said guideway has a rear surface configured to be flush with a rear surface of said tool to facilitate its use.

22. The tool of claim 19 further comprising a projection in each of said guideways for slidable engagement with a groove provided on only one given surface of said straightedge to assure proper orientation of the straightedge when inserted into an associated guideway.

23. The tool of claim 22 further comprising a projection in each of said guideways for slidable engagement with a groove provided on only one given surface of said straightedge to assure proper orientation of the straightedge when inserted into an associated guideway.

24. The tool of claim 22 further comprising graduations on a surface opposite said given surface to facilitate a measurement activity.

25. A multi-purpose hand tool comprising:

a main body having first and second opposing major surfaces, the first major surface being substantially planar to facilitate placement of the first main surface of a wall to be marked during a marking operation;

a surface portion of the second major surface adjacent to the straight-edge having graduations therealong being positioned adjacent said straight edge to facilitate performance of measurements along said surface to be marked;

at least one short side of said main body being straight and linear and perpendicular to said straight edge to facilitate placement of the tool against surfaces having an inside corner;

a cover fixed to one end of said main body, said cover and an adjacent edge of said main body having smoothly curved undulations which cooperate to provide a surface for placement and comfortable seating of fingers of a hand holding said tool; and said cover cooperating with said main body to provide a plurality of guideways for selectively receiving one end of a second elongated straightedge, each guideway aligning the second straightedge at different angles to the first mentioned straightedge.

* * * * *